US005740929A

United States Patent [19]

Frankel

[11] Patent Number: 5,740,929

[45] Date of Patent: Apr. 21, 1998

[54] TOILETRY ARTICLE STORAGE SYSTEM

[76] Inventor: Gail B. Frankel, 5710 Glen Heather Dr., Dallas, Tex. 75252

[21] Appl. No.: 721,086

[22] Filed: Sep. 24, 1996

[51] Int. Cl.[6] ..... A47G 29/00

[52] U.S. Cl. ..... 211/71.01; 211/65; 206/362.1; 206/77.1; 206/576; 206/581; 206/457; D6/528; D6/530; D6/531

[58] Field of Search ..... 211/71.01, 65; D6/527, 528, 529, 530, 531, 532, 534, 535, 536, 539; 248/908; 206/362.1, 362.2, 77.1, 576, 581, 457, 217; 132/310, 311

[56] References Cited

U.S. PATENT DOCUMENTS

| | | | |
|---|---|---|---|
| D. 166,088 | 8/1952 | Lindsay | D4/3 |
| D. 176,162 | 11/1955 | Steece | D6/528 |
| D. 191,496 | 10/1961 | Damiani | D4/3 |
| D. 199,557 | 11/1964 | Lefco | D4/3 |
| D. 200,189 | 2/1965 | Margolin | D6/529 |
| D. 213,977 | 4/1969 | Powers | D6/1 |
| D. 236,298 | 8/1975 | Baca | D6/539 |
| D. 267,060 | 11/1982 | Iwamoto | D6/530 |
| D. 279,248 | 6/1985 | Oliver | D6/534 |
| D. 306,811 | 3/1990 | DeLeon | D6/531 |
| 1,566,193 | 12/1925 | Foster et al. | 211/65 X |
| 1,975,691 | 10/1934 | Hibbs | D6/531 X |
| 2,074,248 | 3/1937 | Barbour | 248/108 |
| 3,105,612 | 10/1963 | Krasnoff et al. | 222/93 |
| 3,138,813 | 6/1964 | Kaplan | 15/22 |
| 3,170,265 | 2/1965 | Goldfarb | D6/534 X |
| 4,565,335 | 1/1986 | Rankin | 248/905 X |
| 5,215,193 | 6/1993 | Dennis | 206/223 |
| 5,638,840 | 6/1997 | Lee et al. | D6/531 X |

*Primary Examiner*—Laurie K. Cranmer
*Attorney, Agent, or Firm*—Haynes and Boone, L.L.P.

[57] ABSTRACT

A toiletry article storage system includes a main body portion, configured to resemble a body portion of an elephant and having first, second, third and fourth members, and an upper body portion configured to resemble an elephant head and having fifth, sixth and seventh members. Each of the first and second members outwardly project from a front side surface of the main body portion. Respective side surfaces of the first and second members are generally parallel with, and spaced apart from, each other to define a first opening sized to slidingly receive a liquid soap dispenser supported by a surface on which the storage system rests. Each of the third and fourth members outwardly project from a rear side surface of the main body portion. Respective side surfaces of the third and fourth members are generally curved and spaced apart from each other to define a second, generally circular, opening sized to captively retain a stand-up toothpaste tube supported by the surface. The fifth member and sixth members laterally project from respective side surfaces of the upper body portion while the seventh member upwardly projects from a generally flat top side surface of the upper body portion. Apertures for supportable holding a pair of toothbrushes above the surface are respectively formed in the fifth and sixth members and a cup is positioned on the top side surface of the upper body portion such that the seventh member extends into the interior thereof.

33 Claims, 2 Drawing Sheets

TOILETRY ARTICLE STORAGE SYSTEM

BACKGROUND OF THE INVENTION

1. Field of the Invention

The present invention is related to a toiletry article storage system and, more particularly, to an toiletry article storage system configured to simultaneously store plural toiletry articles such as toothbrushes, an upright toothpaste dispenser, disposable cups and soap in a space efficient manner.

2. Description of Related Art

Toiletries encompass any composition, for example, deodorant, soap, or toothpaste, or article, for example, a comb, toothbrush or rinse cup used to clean or groom oneself. Typically, such compositions and articles are stored or carefully positioned in proximity to the location, most commonly, the sink area of the bathroom, where one would accomplish such tasks. As most persons use many such toiletry articles on a daily basis, the area proximate to the bathroom sink often becomes cluttered or messy, particularly when a person does not carefully return each individual toiletry article to its original location. Children in particular are notorious for failing to properly return such articles to their original locations.

As a result, therefore, various types of organizers and other storage systems for toiletry articles have been proposed. Indeed, many bathrooms come equipped with a holder for a glass and a plurality of toothbrushes fixedly mounted to the wall in close proximity to the sink. Typically, such holders include a series of brush receiving slots, each sized to receive a handle portion of a toothbrush, provided at spaced locations surrounding a generally circular depressed central body portion sized to supportably receive a glass commonly used to rinse teeth after brushing. A variant of this holder is disclosed in U.S. Pat. No. 2,074,248 to Barbour. Barbour differs from the aforementioned holder by its inclusion of a threaded opening sized to receive a neck portion of a toothpaste tube.

In general, whenever the housing of toiletries other than the toothbrush has been proposed, the use of some variant of a depression or other housing sized to receive the toiletry has been contemplated. See, for example, U.S. Pat. No. 3,138,813 to Kaplan, U.S. Pat. No. 5,215,193 to Dennis and U.S. Des. Pat. No. 200,1898 to Margolin. Some holders do, however, disclose other types of structure to house toiletry articles. For example, in U.S. Des. Pat. No. 199,557, a toothbrush is supported between the front legs and the trunk of an elephant which stands upright. In U.S. Des. Pat. No. 213,977, a cup is shown projecting from the bottom side surface of the combined toothbrush and paste holder and cup and mouthwash dispenser illustrated therein. While not specifically illustrated in the drawing, presumably, the cup is circumferentially held by some type of retaining structure which grabs the cup around a projecting lip structure thereof.

It should also be appreciated that countertop space, particularly in smaller bathrooms, in close proximity to the sink is often quite limited. Thus, in order for a countertop-supported organizer or other storage system for holding toiletry articles to not interfere with other uses of the countertop, it must hold these articles in a space-efficient manner without consuming significant amounts of countertop space.

It can be readily seen from the foregoing that it would be desirable to provide an organizer or other storage system configured to simultaneously store a wide array of toiletry articles in a space-efficient manner. It is accordingly an object of the present invention to provide such an improved toiletry article storage system.

SUMMARY OF THE INVENTION

In one embodiment, the present invention is of a toiletry article storage system which includes a main body portion and first and second members, each of which outwardly project from a first side surface of the main body portion. A side surface of the first member is spaced apart from a side surface of the second member to define an opening sized to receive a first toiletry article supported by a surface on which the toiletry article storage system rests. When the first toiletry article is placed in the opening, its movement is restrained by the side surface of the first member, the second member and the main body portion. In one aspect thereof, the side surface of the main body portion is a front side surface and the side surfaces of the first and second members are generally parallel to each other such that the first toiletry article may be slidingly received therebetween. In an alternate aspect thereof, the side surface of the main body portion is a rear side surface and side surfaces of the first and second members are generally curved such that the opening defined thereby is generally circular. In this aspect, the first toiletry article is captively retained by the side surfaces of the first and second members. The first and second members may be formed of a flexible material and include respective end side surfaces, spaced apart from each other such that the first and second members are deformable.

In further aspects thereof, the main body portion includes an upper body portion having a generally flat top side surface on which a liquid receptacle may be supported by placing a lip portion thereof on the top side surface. Preferably, the upper body portion includes a third member upwardly projecting from the top side surface thereof such that it will extend into an interior portion of the liquid receptacle when placed on the top side surface of the upper body portion. In still further aspects thereof, the upper body portion further includes fourth and fifth members which laterally project from first and second side surfaces, respectively, of the upper body portion. Each of the fourth and fifth members include an aperture formed therein for respectively supporting second and third toiletry article above the surface.

In another embodiment, the present invention is of a toiletry article storage system which includes a main body portion and first, second, third and fourth members. Each of the first and second members outwardly project from a front side surface of the main body portion. Respective side surfaces of the first and second members are spaced apart from each other to define a first opening sized to receive a first toiletry article supported by a surface on which the toiletry article storage system rests. When the first toiletry article is placed in the first opening, its movement is restrained by the side surfaces of the first member, the second member and the main body portion. Each of the third and fourth members outwardly project from a rear side surface of the main body portion. Respective side surfaces of the third and fourth members are spaced apart from each other to define a second opening sized to receive a second toiletry article supported by the surface on which the toiletry article storage system rests. When the second toiletry article is placed in the second opening, its movement is restrained by the side surfaces of the third and fourth members.

In one aspect thereof, the side surfaces of the first and second members are generally parallel to each other such that the first toiletry article capable may be slidingly received therebetween. In another aspect thereof, the side surfaces of the third and fourth member are generally curved such that the second toiletry article may be captively retained by the generally circular opening defined by the third and fourth members. In still another aspect thereof, the toiletry article storage system further includes an upper body portion having a generally flat top side surface. A liquid receptacle may be supported by placing a lip portion thereof on the top side surface. Preferably, the upper body portion further includes a fifth member upwardly projecting from the top side surface thereof such that it will extend into an interior portion of the liquid receptacle when placed on the top side surface of the upper body portion. In yet another aspect thereof, the upper body portion further includes a pair of additional members which laterally project past the first and second side surfaces, respectively. An aperture for supportably holding an additional toiletry article above the surface is formed in each of these additional members.

In yet another embodiment, the present invention is of a toiletry article storage system which includes a main body portion having first, second, third and fourth members and an upper body portion, attached to the main body portion, having fifth, sixth and seventh members. Each of the first and second members outwardly project from a front side surface of the main body portion. Respective side surfaces of the first and second members are generally parallel with, and spaced apart from, each other to define a first opening sized to slidingly receive a first toiletry article supported by a surface on which the toiletry article storage system rests. When the first toiletry article is placed in the first opening, its movement is restrained by the side surfaces of the first member, the second member and the main body portion. Each of the third and fourth members outwardly project from a rear side surface of the main body portion. Respective side surfaces of the third and fourth members are generally curved and spaced apart from each other to define a second, generally circular, opening sized to captively retain a second toiletry article supported by the surface on which the toiletry article storage system rests. When the second toiletry article is placed in the second opening, its movement is restrained by the side surfaces of the third and fourth members. The fifth member and sixth members laterally project from respective side surfaces of the upper body portion while the seventh member upwardly projects from a generally flat top side surface of the upper body portion. Apertures for supportably holding third and fourth toiletry articles above the surface are respectively formed in the fifth and sixth members. The toiletry article storage system may also support a liquid receptacle by placing a lip portion thereof on the top side surface of the upper body portion such that the seventh member supports the liquid receptacle by extending into an interior space defined by a sidewall of the liquid receptacle.

In one aspect thereof, the main body portion of the toiletry article storage system is configured to resemble a body portion of an elephant. In another aspect thereof, the first and second members of the main body portion are configured to resemble first and second forelegs of the body portion of the elephant. In yet another aspect thereof, the upper body portion of the toiletry article storage system is configured to resemble a head portion of an elephant and, in still another aspect thereof, the fifth and sixth members of the upper body portion are respectively configured to resemble first and second ears of the elephant.

BRIEF DESCRIPTION OF THE DRAWING

The invention will be better understood and its numerous objects and advantages will become apparent to those skilled in the art by reference to the following drawing in which.

DETAILED DESCRIPTION

Figure 2:
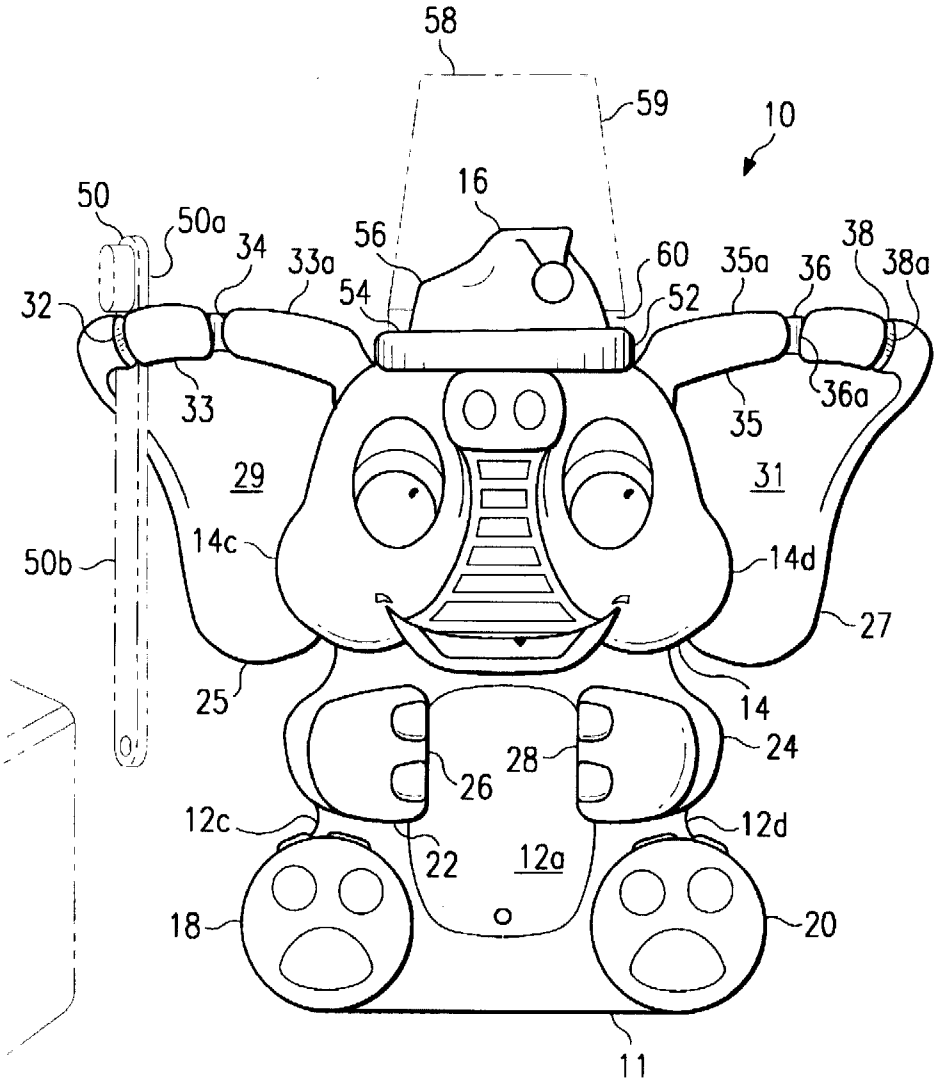
FIG. 2 is a front view of the toiletry storage system of FIG. 1.
Figure 1:
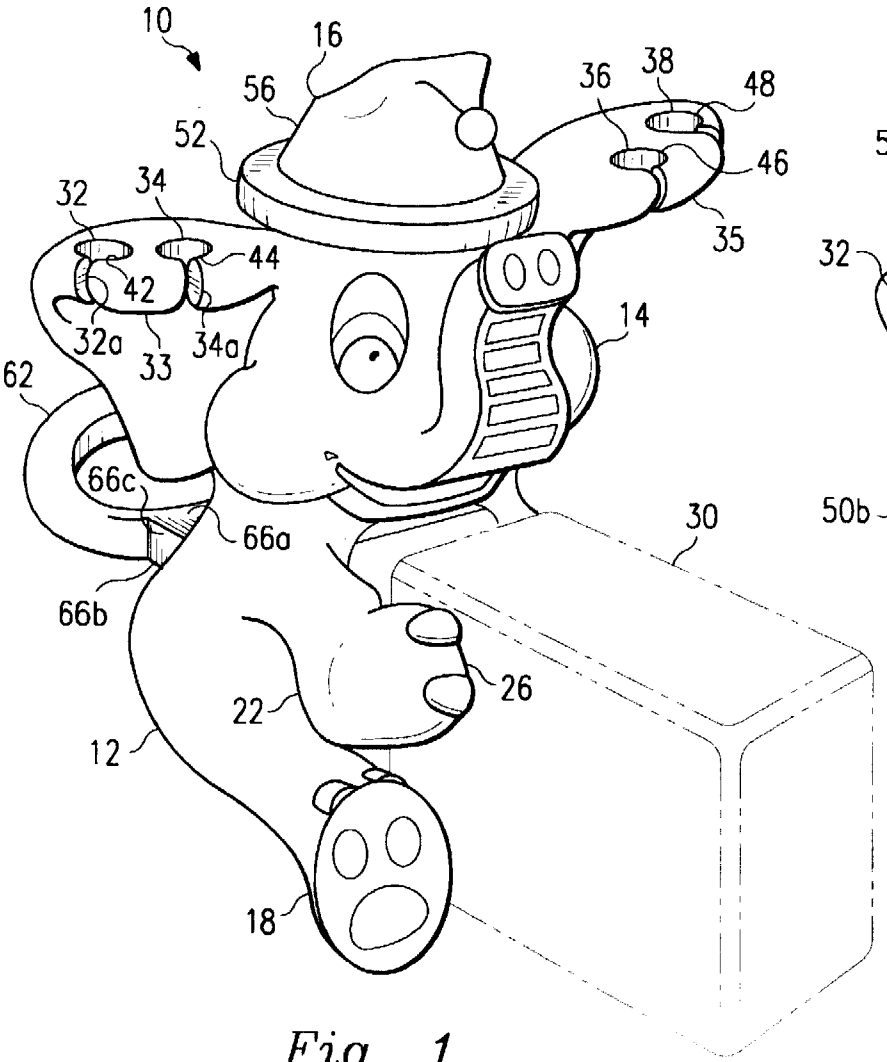
FIG. 1 is a perspective view of a toiletry article storage system constructed in accordance with the teachings of the present invention and configured for storing a wide array of toiletry articles in a space efficient, child pleasing structure.
Figure 3:
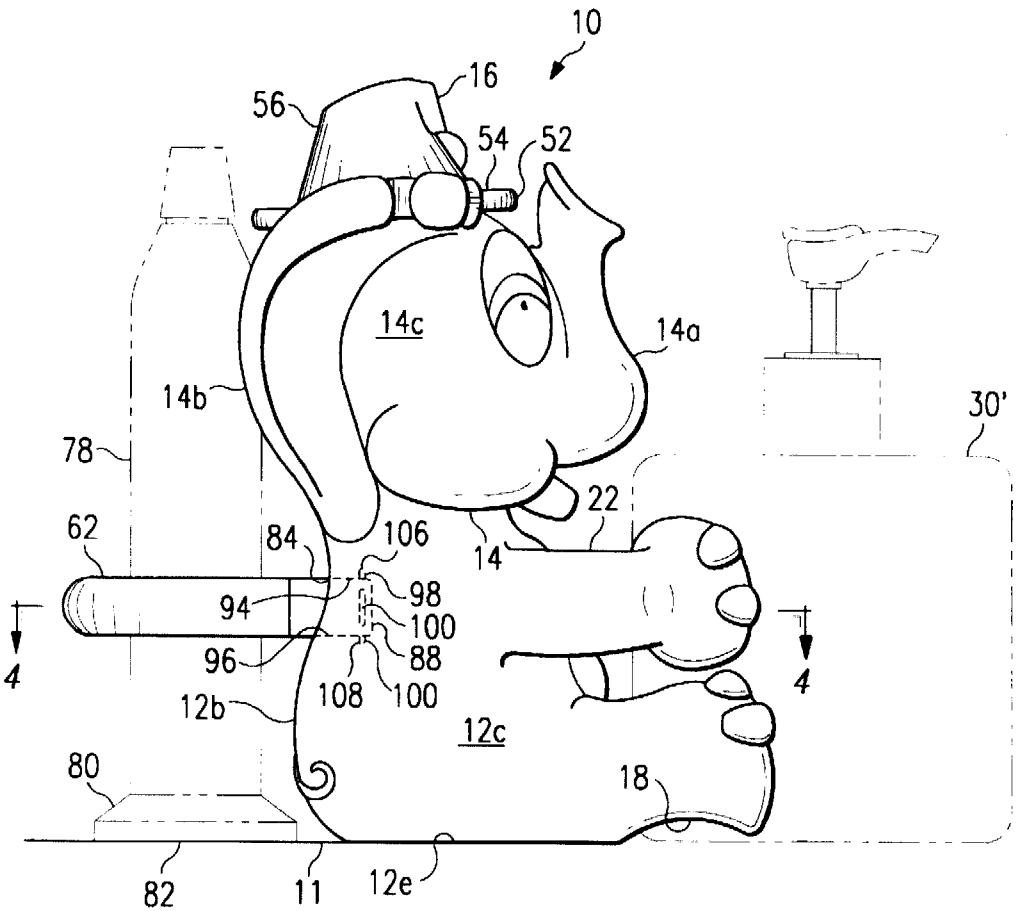
FIG. 3 is a side view of the toiletry storage system of FIGS. 1–2.

Referring first to FIGS. 1–3, a space efficient toiletry article storage system 10 specially configured to achieve a child pleasing design may now be seen. More specifically, the toiletry article storage system 10 is configured to resemble an elephant, in a sitting position, wearing a hat and having an animated, cheerful expression. The toiletry article storage system 10 includes a lower body portion 12, an intermediate body portion 14 and an upper body portion 16. The lower body portion 12 is configured to resemble the body of an elephant and includes a front side surface 12*a*, a rear side surface 12*b*, first and second side surfaces 12*c* and 12*d*, and a bottom side surface 12*e* which supports the toiletry article storage system 10 on a surface 11, typically horizontal, for example, a bathroom countertop.

The lower body portion further includes first, second, third and fourth members 18, 20, 22 and 24, each of which outwardly projects from the front side surface 12*a* of the lower body portion 12. The first and second members 18 and 20 which outwardly project from the front side surface 12*a* of the main body portion 12 are configured to resemble hind legs of an elephant while the third and fourth members 22 and 24 which outwardly project from the front side surface 12*a* of the main body portion 12 are configured to resemble the fore legs of an elephant. Each of the third and fourth members 22 and 24 respectively terminate at end surfaces 26 and 28 which, as may be best seen in FIG. 2, face each other. To provide the end surfaces 26 and 28, the third and fourth members may bend inwardly as they project outwardly from the front side surface 12*a*, may widen as they project outwardly from the front side surface 12*a*, or both. As may also be seen in FIG. 2, the end surfaces 26 and 28 are spaced apart a specified distance in a generally parallel orientation, thereby providing structure used to retain a first toiletry article. Specifically, as illustrated in FIG. 1, a bar of soap 30 may be inserted between the end surfaces 26 and 28 and held in place by the frictional engagement between the bar of soap 30 and the end surfaces 26 and 28. Alternately, as illustrated in FIG. 3, a liquid soap dispenser 30' may be inserted between the end surfaces 26 and 28 and held in place by the frictional engagement between the liquid soap dispenser 30' and the end surfaces 26 and 28.

The intermediate body portion 14 is configured to resemble the head of an elephant and includes a front side surface 14*a*, a rear side surface 14*b* and first and second side surfaces 14*c* and 14*d*. The intermediate body portion 14 further includes first and second members 25 and 27. The first and second members 25 and 27 laterally project from first and second side surfaces 14*c* and 14*d*, respectively, of the intermediate body portion 14. The first and second members 25 and 27 which laterally project from the first and second side surfaces 14*c* and 14*d*, respectively, of the intermediate body portion 14 are respectively comprised of a generally vertical back wall 29, 31 integrally formed with a generally horizontal top wall 33, 35 and configured to resemble an ear of an elephant. Respectively formed in the top wall 33, 35 of the first and second members 25 and 27 are first and second openings 32 and 34, 36 and 38. The first and second openings 32 and 34 extend through the top wall 33 of the first member 25 while the first and second openings 36 and 38 extend through the top wall 35 of the second member 27. Each opening 32, 34, 36 and 38 respectively includes a generally circular central portion 42, 44 46 and 48 sized to captively retain a toothbrush 50, one of which is illustrated in phantom in FIG. 2, above the surface 11. Accordingly, the diameter of each opening 32, 34, 36, and 38 should be greater than a width dimension of a body portion 50*b* of the toothbrush while less than a height dimension of a brush portion 50*a* of the toothbrush 50. Furthermore, in order for the toothbrush 50 to be suspended above the surface 11, it is preferred that the lower and intermediate body portions 12 and 14 be sized that the distance between an upper side surface 33*a*, 35*a* of the top wall 33, 35 of the first and second members 25, 27 and the surface 11 be greater than the length of the shaft portion 50*b* of the toothbrush 50. If desired, each opening 32, 34, 36 and 38 may further include a narrowed portion 32*a*, 34*a*, 36*a*, and 38*a* to facilitate insertion and removal of the toothbrush 50.

The upper body portion 16 includes a generally cylindrical upper part 52 having a top side surface 54 and a central portion 56 which upwardly projects from the top side surface 54 of the generally cylindrical upper part 52. The top side surface 54 is sized to support one or more liquid receptacles 58, one of which is illustrated in phantom in FIG. 2, arranged in an inverted stacked orientation such that a lip portion 60 of the lowermost receptacle 58 rests on the top side surface 54 of the generally cylindrical upper part 52. The central portion 56 upwardly projects from the top side surface 54 of the generally cylindrical upper part 52 in a roughly frusto-conical configuration such that the receptacle 58, when supported by the base portion 52, is placed over the central portion 56 such that the central portion 56 partially projects into an interior space defined by the receptacle 58. In this manner, the central portion 56 acts as a support member which assists in retaining the receptacle 58 in place. For example, if the receptacle 58 receives a glancing blow, lateral movement of the receptacle 58 will drive a sidewall portion 59 thereof into engagement with the central portion 56, thereby stopping lateral movement of the receptacle 58 and preventing the blow from knocking the receptacle 58 off of the generally cylindrical upper part 52 of the upper body portion 16. Preferably, the upper body portion 16 is configured to resemble a party hat or other type of fanciful headwear.

Figure 4:
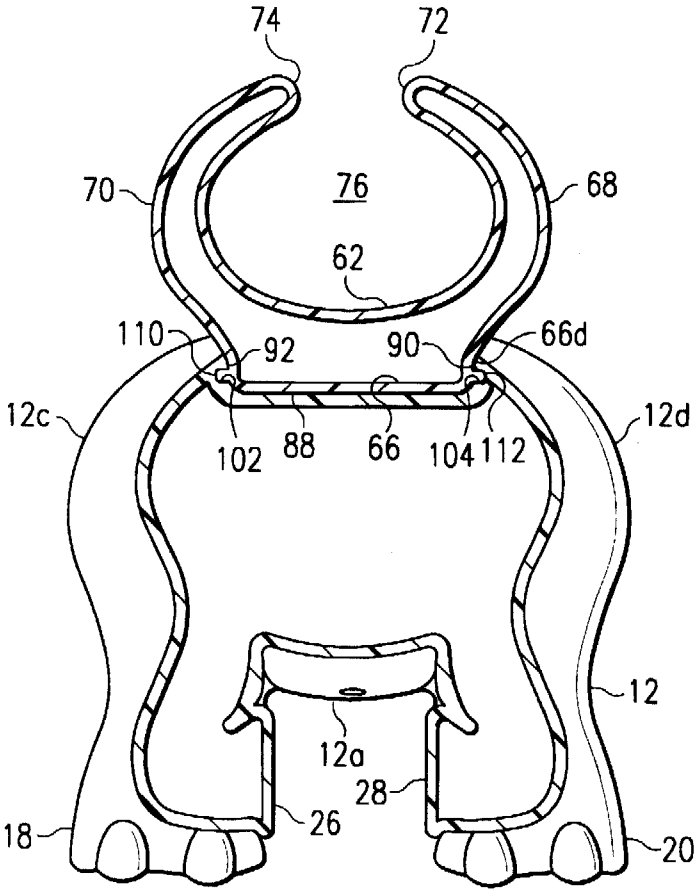
FIG. 4 is a cross-sectional view taken along lines 4—4 of FIG. 3.

Referring now to FIGS. 3 and 4, a fourth support structure portion of the toiletry article storage system 10 will now be described in greater detail. As may now be seen, a clamping structure 62, preferably configured in a general "C" shape, is removably mounted to, and outwardly projects from, the back side surface 12*b* of the main body portion 12. The C-shaped clamping structure 62 is comprised of a central body portion 66 having a top side surface 66*a*, a bottom side surface 66*b* and first and second side surfaces 66*c* and 66*d*. Formed on each of the top side surface 66*a*, bottom side 66*b* and first and second side surfaces 66*c* and 66*d* is a mounting projection 106, 108, 110 and 112 used to assist in the securement of the C-shaped clamping structure 62 to the main body portion 12 in a manner to be more fully described below.

Outwardly extending from the central body portion 66 of the C-shaped clamping structure 62 are first and second curved projections 68 and 70 which provide the illustrated general C-shape of the clamping structure 62. An interior space 76 is defined by the central body portion 66, the first curved projection 68 and the second curved projection 70. The first and second curved projections 68 and 70 respectively terminate in end surfaces 72 and 74 which are spaced apart from each other a specified distance. As the C-shaped clamping structure 62 is formed from a soft, deformable material, the first and second curved projections 68 and 70 may be readily manipulated to deform the size of aperture or the distance separating the end surfaces 72 and 74.

The C-shaped clamping structure 62 is insertably mounted to the back side surface 12*b* of the main body portion 12. More specifically, a generally rectangular slot 86, which extends from the back side surface 12*b* to an interior side surface 88, is formed in the main body portion 12 of the toiletry storage system 10. The slot 86 is defined by the interior side surface 88 and first, second, third and fourth interior walls 90, 92, 94 and 96. Preferably, the length and width of the slot 86 are dimensioned to be slightly greater than the length and width of the central body portion 66 of the C-shaped clamping structure 62. Formed in the general center of each of the first, second, third and fourth interior walls 90, 92, 94 and 96 is a receiving slot 98, 100, 102 and 104. To mount the C-shaped clamping structure 62 to the main body portion 12, the central body portion 66 is inserted into the slot 84 such that the mounting projections 106, 108, 110 and 112 are respectively received in the receiving slot 98, 100, 102 and 104 and the top side surface 66*a*, bottom side 66*b* and first and second side surfaces 66*c* and 66*d* of the central body portion 66 frictionally engage the first, second, third and fourth interior walls 90, 92, 94 and 96, respectively.

In accordance with the teachings of the present invention, the clamp structure 62 may be used to secure a stand-up toothpaste container 78 (shown in phantom in FIG. 3) by inserting the toothpaste container 78 through the interior opening 76 defined by the clamp structure 62 until a bottom side surface 82 thereof rests upon the surface 11. While it is contemplated that the interior opening 76 be sized such that most toothpaste containers 78 may be readily inserted therethrough for retainment by the central body portion 66 and the first and second curved projections 68 and 70, it should be noted that a widthwise dimension of certain toothpaste containers may be greater than that of the interior opening 76. In such a situation, the interior opening 76 may be temporarily enlarged by deforming the first and second curved projections 68 and 70, for example, by pulling the first curved projection 68 in a first direction generally parallel with the surface 11 and pulling the second curved projection in a second direction, opposite to the first direction, generally parallel to the surface 11, to the extent necessary so that the interior opening 76 will accommodate the toothpaste container 78. Other toothpaste containers may include a portion, for example a base portion 80, which is wider than the interior opening 76. In such situations, the first and second curved projections 68 and 70 would need to be pulled apart until the space separating the end surfaces 72 and 74 is sufficiently large to permit the body of such a toothpaste container to pass therethrough while being inserted into the interior opening 76 for retainment by the central body portion 66 and the first and second curved projections 68 and 70.

While there are specific advantageous achieved by configuring the clamp structure 62 in the aforementioned C shape, it should be noted, however, that, as the purpose of the C-shaped clamp structure 62 is to retain the toothpaste container 72 within the interior opening 76 defined by the central body portion 66 and the first and second curved projections 68 and 70, the clamp structure 62 may be arranged in various other configurations which are suitable for the uses contemplated herein. For example, a ring-shaped configuration whereby the respective end surfaces 72 and 74 of the first and second curved projections 68 and 70 are joined together, for example, by forming the clamp structure 62 as a single, integrally formed member, thereby forming a ring in which the toothpaste container 72 may be insertably retained.

Thus, there has been described and illustrated herein, a toiletry article storage device configured to hold multiple toiletry articles such as a liquid soap container, a stand-up toothpaste tube, one to four toothbrushes and a stack of disposable drinking cups. In addition, rather than merely holding these items, the disclosed toiletry article storage device holds them in a very space-efficient manner such that the "footprint" of the storage device on a countertop or other horizontal support surface is relatively small. More Specifically, the first pair of projections which extend from the front side surface to hold the liquid soap container, the second pair of projections which extend from the back side surface to hold the stand-up toothpaste tube and the top side surface of the generally cylindrical upper part are aligned such that a plane, generally orthogonal to the countertop, will extend through the general center of the toiletry articles respectively supported by the first pair of projections, the second pair of projections and the top side surface. By supporting the toiletry articles in this orientation, the footprint of the toiletry article storage device is minimized.

However, those skilled in the art will recognize that numerous modifications and variations from that specifically disclosed herein are possible without substantially departing from the scope of the present invention. It should be clearly understood, therefore, that the embodiment of the invention disclosed herein is considered to be exemplary only and should not be construed as limiting the invention, which is defined only by the claims appended hereto.

What is claimed is:

1. A toiletry article storage system, comprising:

a main body portion having a side surface and first and second members;

each of said first and second members outwardly projecting from said side surface of said main body portion and having a side surface;

said side surface of said first member spaced apart from said side surface of said second member to define an opening sized to receive a first toiletry article supportable by a surface on which said toiletry article storage system rests such that movement of said first toiletry article, when placed in said opening, is restrained by said side surface of said first member and said side surface of said second member;

an upper body portion attached to said main body portion, said upper body portion having a central portion and a peripheral edge portion which circumferentially surrounds said central portion, said peripheral edge portion having a generally flat top side surface;

wherein a liquid receptacle may be supported by said toiletry article storage system by placing a lip portion of said liquid receptacle on said generally flat top side surface of said peripheral edge portion of said upper body portion.

2. A toiletry article storage system according to claim 1 wherein:

said side surface of said main body portion is a front side surface;

said side surface of said first member is generally parallel to said side surface of said second member;

said first toiletry article capable of being slidingly received between said side surface of said first member and said side surface of said second member.

3. A toiletry article storage system according to claim 2 wherein said first and second members are integrally formed with said main body portion.

4. A toiletry article storage system according to claim 1 wherein said central portion projects upwardly relative to said top side surface of said peripheral edge portion of said upper body portion;

wherein said central portion supports said liquid receptacle placed on said top side surface of said peripheral edge of said upper body portion by extending into an interior space defined by a sidewall of said liquid receptacle when said lip of said liquid receptacle is placed on said top side surface of said peripheral edge portion of said upper body portion.

5. A toiletry article storage system according to claim 4 wherein said upper body portion further comprises:

first and second side surfaces;

a fourth member laterally projecting from said first side surface of said upper body portion;

a fifth member laterally projecting from said second side surface of said upper body portion;

said fourth member having an aperture formed therein for supportably holding a second toiletry article above said surface; and said fifth member having an aperture formed therein for supportably holding a third toiletry article above said surface.

6. A toiletry article storage system, comprising:

a main body portion having a rear side surface and first and second members, each of said first and second members having a side surface;

each of said first and second members being generally curved and outwardly projecting from said rear side surface of said main body portion;

said side surface of said first member spaced apart from said side surface of said second member to define a generally circular opening sized to receive and captively retain a first toiletry article supportable by a surface on which said toiletry article storage system rests such that movement of said first toiletry article, when placed in said generally circular opening, is restrained by said side surface of said first member and said side surface of said second member;

each of said first and second members being formed of a flexible material and including an end side surface;

said end side surface of said first member being spaced apart from said end side surface of said second member;

said first and second members being deformable to assist in placing said first toiletry article in said generally circular opening by temporarily enlarging said generally circular opening and increasing said spacing between said first end side surface and said second end side surface.

7. A toiletry article storage system according to claim 6 wherein said main body portion further comprises:

an upper body portion attached to said main body portion and having a generally flat top side surface;

wherein a liquid receptacle may be supported by said toiletry article storage system by placing a lip portion of said liquid receptacle on said top side surface of said upper body portion.

8. A toiletry article storage system according to claim 7 wherein said upper body portion further comprises:

a third member upwardly projecting from said top side surface of said upper body portion;

wherein said third member supports said liquid receptacle placed on said top side surface of said upper body portion by extending into an interior space defined by a sidewall of said liquid receptacle when said lip of said liquid receptacle is placed on said top side surface of said upper body portion.

9. A toiletry article storage system according to claim 8 wherein said upper body portion further comprises:

first and second side surfaces;

a fourth member laterally projecting from said first side surface of said upper body portion;

a fifth member laterally projecting from said second side surface of said upper body portion;

said fourth member having an aperture formed therein for supportably holding a second toiletry article above said surface; and said fifth member having an aperture formed therein for supportably holding a third toiletry article above said surface.

10. A toiletry article storage system according to claim 6 wherein said main body portion further comprises:

an upper body portion attached to said main body portion and having first and second side surfaces, said upper body portion including a third member laterally projecting from said first side surface of said upper body portion and a fourth member laterally projecting from said second side surface of said upper body portion;

said third member having an aperture formed therein for supportably holding a second toiletry article above said surface; and said fourth member having an aperture formed therein for supportably holding a third toiletry article above said surface.

11. A toiletry article storage system, comprising:

a main body portion having a rear side surface and a slot formed therein;

a central member part having a flange;

first and second members integrally formed with said central member part, each of said first and second members having a side surface;

said flange being received in said slot to insertably mount said central member part to said main body portion;

each of said first and second members being generally curved and outwardly projecting from said rear side surface of said main body portion;

said side surface of said first member spaced apart from said side surface of said second member to define a generally circular opening sized to receive and captively retain a first toiletry article supportable by a surface on which said toiletry article storage system rests such that movement of said first toiletry article, when placed in said opening, is restrained by said side surface of said first member and said side surface of said second member.

12. A toiletry article storage system according to claim 11 wherein:

each of said first and second members are formed of a flexible material and include an end side surface;

said end side surface of said first member spaced apart from said end side surface of said second member;

said first and second members being deformable to assist in placing said first toiletry article in said opening.

13. A toiletry article storage system, comprising:

a main body portion having a front side surface, a rear side surface and first and second members;

each of said first and second members having a side surface and outwardly projecting from said front side surface of said main body portion;

said side surface of said first member spaced apart from said side surface of said second member to define a first opening sized to receive a first toiletry article supportable by a surface on which said toiletry article storage system rests such that movement of said first toiletry article, when placed in said first opening, is restrained by said side surface of said first member and said side surface of said second member;

a central member part having a flange;

third and fourth members integrally formed with said central member part;

said flange being received in a slot formed in said main body portion to insertably mount said central member part to said main body portion;

each of said third and fourth members having a side surface and outwardly projecting from said rear side surface of said main body portion;

said side surface of said third member spaced apart from said side surface of said fourth member to define a second opening sized to receive a second toiletry article supported by said surface such that movement of said second toiletry article, when placed in said second opening, is restrained by said side surface of said third member and said side surface of said fourth member.

14. A toiletry article storage system according to claim 13 wherein:

said side surface of said first member is generally parallel to said side surface of said second member;

said first toiletry article capable of being slidingly received between said side surface of said first member and said side surface of said second member.

15. A toiletry article storage system according to claim 13 wherein:

said side surface of said third member and said side surface of said fourth member which define said second opening are generally curved such that said second opening defined thereby is a generally circular opening;

said second toiletry article capable of being captively retained by said side surface of said third member and said side surface of said fourth member.

16. A toiletry article storage system according to claim 15 wherein:

said side surface of said first member is generally parallel to said side surface of said second member;

said first toiletry article capable of being slidingly received between said side surface of said first member and said side surface of said second member.

17. A toiletry article storage system according to claim 16 wherein said first and second members are integrally formed with said main body portion.

18. A toiletry article storage system according to claim 16 wherein said main body portion further comprises:

an upper body portion attached to said main body portion and having a generally flat top side surface;

wherein a liquid receptacle may be supported by said toiletry article storage system by placing a lip portion of said liquid receptacle on said top side surface of said upper body portion.

19. A toiletry article storage system according to claim 18 wherein said upper body portion further comprises:

a fifth member upwardly projecting from said top side surface of said upper body portion;

wherein said fifth member supports said liquid receptacle placed on said top side surface of said upper body portion by extending into an interior space defined by a sidewall of said liquid receptacle when said tip of said liquid receptacle is placed on said top side surface of said upper body portion.

20. A toiletry article storage, system according to claim 16 wherein said main body potion further comprises:

an upper body potion attached to said main body portion and having first and second side surfaces, said upper body portion including a fifth member laterally projecting from said first side surface of said upper body portion and a sixth member laterally projecting from said second side surface of said upper body portion;

said fifth member having an aperture formed therein for supportably holding a third toiletry article above said surface; and said sixth member having an aperture formed therein for supportably holding a fourth toiletry article above said surface.

21. A toiletry article storage system according to claim 20 wherein said upper body portion further comprises:

a generally flat top side surface;

wherein a liquid receptacle may be supported by said toiletry article storage system by placing a lip portion of said liquid receptacle on said top side surface of said upper body portion.

22. A toiletry article storage system according to claim 21 wherein said upper body portion further comprises:

a seventh member upwardly projecting from said top side surface of said upper body portion;

wherein said seventh member supports said liquid receptacle placed on said top side surface of said upper body portion by extending into an interior space defined by a sidewall of said liquid receptacle when said lip of said liquid receptacle is placed on said top side surface of said upper body portion.

23. A toiletry article storage system, comprising:

a main body portion having a front side surface, a rear side surface and first and second members;

each of said first and second members having a side surface, integrally formed with said main body portion and outwardly projecting from said front side surface of said main body;

said side surface of said first member being generally parallel with and spaced apart from said side surface of said second member to define a first opening sized to slidingly receive a first toiletry article supportable by a surface on which said toiletry article storage system rests such that movement of said first toiletry article, when placed in said first opening, is restrained by said side surface of said first member and said side surface of said second member;

a central member part having a flange;

third and fourth members integrally formed with said central member part;

said flange received in a slot formed in said main body portion and extending from said rear side surface to an interior side surface to insertably mount said central member part to said main body portion;

each of said third and fourth members outwardly projecting from said rear side surface of said main body portion and having a generally curved side surface which defines a generally circular second opening;

said side surface of said third member spaced apart from said side surface of said fourth member to captively receive therebetween a second toiletry article supported by said surface such that movement of said second toiletry article, when placed in said second opening, is restrained by said side surface of said third member and said side surface of said fourth member.

24. A toiletry article storage system, comprising:

a main body portion having a front side surface, a rear side surface and first, second, third and fourth members;

each of said first and second members having a side surface and outwardly projecting from said front side surface of said main body portion;

said side surface of said first member spaced apart from and generally parallel to said side surface of said second member to define a first opening sized to slidingly receive a first toiletry article supportable by a surface on which said toiletry article storage system rests such that said first toiletry article, when placed in said first opening, is restrained by said side surface of said first member and said side surface of said second member;

each of said third and fourth members having a side surface and outwardly projecting from said rear side surface of said main body portion;

said side surface of said third member spaced apart from said side surface of said fourth member to define a second opening sized to receive a second toiletry article supported by said surface such that movement of said second toiletry article, when placed in said second opening, is restrained by said side surface of said third member and said side surface of said fourth member;

said side surface of said third member and said side surface of said fourth member which define said second opening being generally curved such that said second opening defined thereby is a generally circular opening;

said second toiletry article capable of being captively retained by said side surface of said third member and said side surface of said fourth member;

an upper body portion attached to said main body portion, said upper body portion having first and second side surfaces, a generally flat top side surface, a fifth member laterally projecting from said first side surface of said upper body portion, a sixth member laterally projecting from said second side surface of said upper body portion and a seventh member upwardly projecting from said top side surface of said upper body portion;

said fifth member having an aperture formed therein for supportably holding a third toiletry article above said surface;

said sixth member having an aperture formed therein for supportably holding a fourth toiletry article above said surface;

said toiletry article storage system further capable of supporting a liquid receptacle by placing a lip portion of said liquid receptacle on said top side surface of said upper body portion such that said seventh member supports said liquid receptacle by extending into an interior space defined by a sidewall of said liquid receptacle.

25. A toiletry article storage system according to claim 24 wherein said main body portion of said toiletry article storage system are configured to resemble a body portion of an elephant.

26. A toiletry article storage system according to claim 25 wherein said first and second members of said main body portion are configured to resemble first and second forelegs of said body portion of said elephant.

27. A toiletry article storage system according to claim 24 wherein said upper body portion of said toiletry article storage system is configured to resemble a head portion of an elephant.

28. An toiletry article storage system according to claim 27 wherein said fifth and sixth members are respectively configured to resemble first and second ears of said elephant.

29. A toiletry article storage system, comprising:

a main body portion having first and second members and front, rear, first side and second side surfaces;

each of said first and second members forwardly projecting from said front surface of said main body portion, elevated relative to a surface on which said toiletry article storage system rests and having a side surface;

said side surface of said first member spaced apart from said side surface of said second member to define an opening sized to receive a first toiletry article, supportable by said surface, such that movement of said first toiletry article, when placed in said opening, is restrained by said side surface of said first member and said side surface of said second member;

an intermediate body portion attached to said main body portion, said intermediate body portion having a third member and front, rear, first side and second side surfaces;

said third member laterally projecting from said first side surface of said intermediate body portion, elevated relative to said first and second members and having an aperture formed therein for supportably holding a second toiletry article;

wherein said first toiletry article restrained by said side surfaces of said first and second members is supported on said surface while said second toiletry article supportably held by said third member is held above said surface.

30. A toiletry article storage system according to claim 29 wherein:

said third member is comprised of a vertically-orientated wall and a horizontally-orientated wall integrally formed with, generally orthogonal to and projecting forwardly from said vertically-orientated wall;

said aperture being formed in said horizontally-orientated wall.

31. A toiletry article storage system according to claim 30 and further comprising:

a fourth member laterally projecting from said second side surface of said intermediate body portion, elevated relative to said first and second members and having an aperture formed therein for supportably holding a third toiletry article;

wherein said third toiletry article supportably held by said third member is held above said surface.

32. A toiletry article storage system according to claim 31 wherein:

said fourth member is comprised of a vertically-orientated wall and a horizontally-orientated wall integrally formed with, generally orthogonal to and projecting forwardly from said vertically-orientated wall;

said aperture formed in said fourth member being formed in said horizontally-orientated wall.

33. A toiletry article storage system according to claim 30 and further comprising:

an upper body portion attached to said intermediate body portion, said upper body portion having a central portion and a peripheral edge portion which circumferentially surrounds said central portion, said peripheral edge portion having a generally flat top side surface;

wherein a liquid receptacle may be supported above said first, second and third toiletry articles by placing a lip portion of said liquid receptacle on said top side surface of said peripheral edge portion of said upper body portion.

* * * * *